US005535681A

United States Patent [19]

Sarnicki et al.

[11] Patent Number: 5,535,681

[45] Date of Patent: Jul. 16, 1996

[54] TELESCOPIC BRIDGE PLATE ASSEMBLY

[75] Inventors: John T. Sarnicki, Elgin; Bruce M. Bullock, Antioch, both of Ill.

[73] Assignee: Standard Car Truck Company, Park Ridge, Ill.

[21] Appl. No.: 376,387

[22] Filed: Jan. 23, 1995

[51] Int. Cl.[6] ..... B61D 49/00

[52] U.S. Cl. ..... 105/458

[58] Field of Search ..... 105/396, 422, 105/425, 436, 457, 458, 459, 460, 401; 296/50, 51, 52, 53, 55, 56, 57.1, 59, 61; 414/340, 343

[56] References Cited

U.S. PATENT DOCUMENTS

| | | | |
|---|---|---|---|
| 20,293 | 5/1858 | Newhall | 105/458 |
| 66,419 | 7/1867 | Traxler . | |
| 68,327 | 8/1867 | Wilcox | 105/458 |
| 68,543 | 9/1867 | Abbot | 105/458 |
| 84,808 | 12/1868 | Elder . | |
| 193,851 | 8/1877 | Cowell | 105/458 |
| 517,519 | 4/1894 | Fitzsimmons | 105/458 |
| 686,797 | 11/1901 | Anderson | 105/458 |
| 701,202 | 5/1902 | Holland et al. | 105/458 |
| 1,051,205 | 1/1913 | Engle | 105/458 |
| 1,449,403 | 3/1923 | Hedley et al. | 105/458 |
| 2,052,867 | 9/1936 | Cartzdafner et al. . | |
| 2,788,751 | 4/1957 | Russell . | |
| 3,001,266 | 9/1961 | Kilbane et al. . | |
| 3,195,478 | 7/1965 | Thompson . | |
| 3,203,364 | 12/1963 | Gutridge . | |
| 3,323,472 | 6/1967 | Boone et al. . | |
| 3,370,552 | 2/1968 | de Podesta et al. . | |
| 3,421,454 | 1/1969 | Connerat . | |
| 3,572,254 | 3/1971 | Slager . | |
| 4,721,426 | 1/1988 | Bell et al. . | |
| 5,004,287 | 4/1991 | Doyle | 296/57.1 |
| 5,010,614 | 4/1991 | Braemert et al. . | |
| 5,244,335 | 9/1993 | Johns . | |
| 5,312,149 | 5/1994 | Boone . | |

FOREIGN PATENT DOCUMENTS

| | | |
|---|---|---|
| 9162 | 9/1902 | Austria . |
| 539581 | 11/1931 | Germany . |
| 806859 | 6/1951 | Germany . |
| 947078 | 8/1956 | Germany . |
| 5139295 | 6/1993 | Japan . |
| 37273 | 1/1914 | Sweden . |

*Primary Examiner*—Mark T. Le

*Attorney, Agent, or Firm*—Dorn, McEachran, Jambor & Keating

[57] ABSTRACT

A bridge plate assembly for use in moving vehicles between rail cars for loading and unloading is of sufficient width to accommodate vehicles of varying wheelbase and includes relatively movable telescopic bridge panel members. One of the panel members has top and bottom face layers bonded to an intermediate low density core. The other panel member is in the form of a hollow shroud which in part encloses the first identified panel member. The relatively movable panel members are biased toward maximum extension and there is a stop for limiting the extension of the panel members.

13 Claims, 4 Drawing Sheets

Fig. 4.
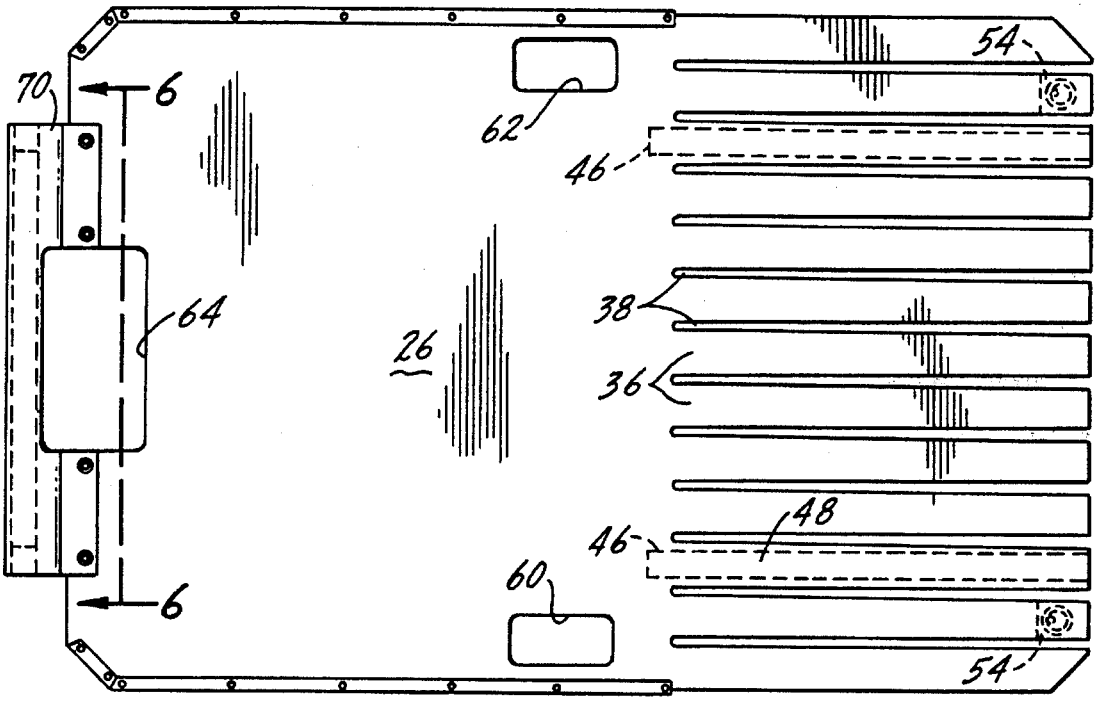
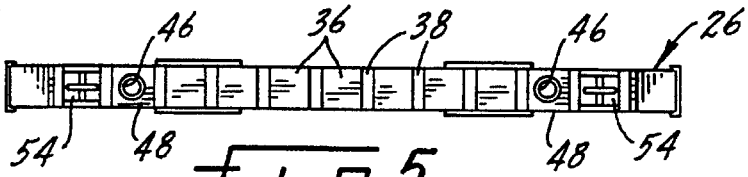
Fig. 5.
Fig. 6.
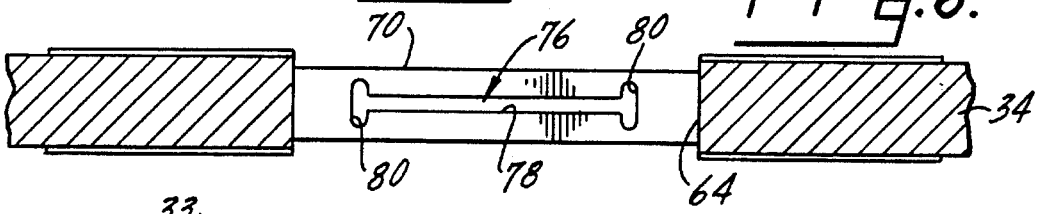
Fig. 7.
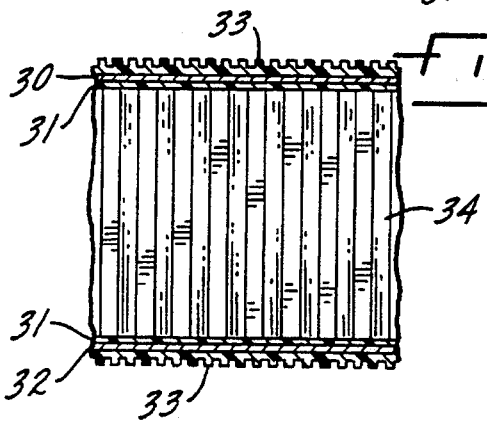
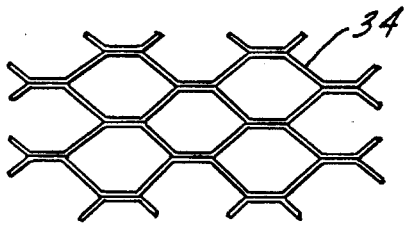
Fig. 8.

Fig. 9.
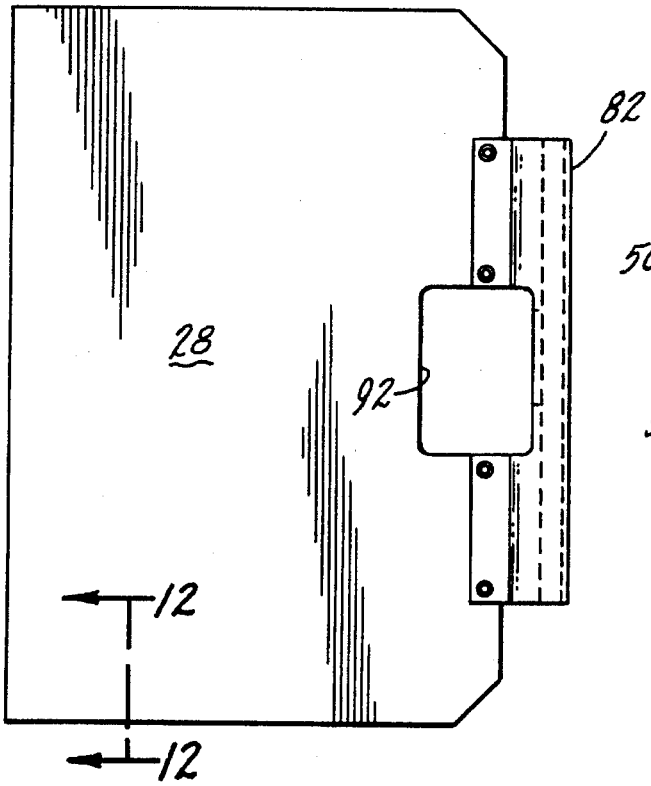
Fig. 11.
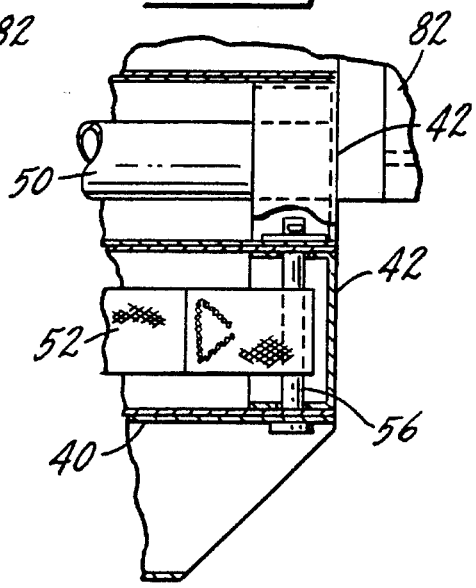
Fig. 10.
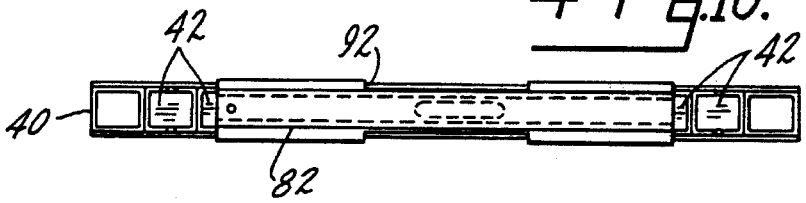
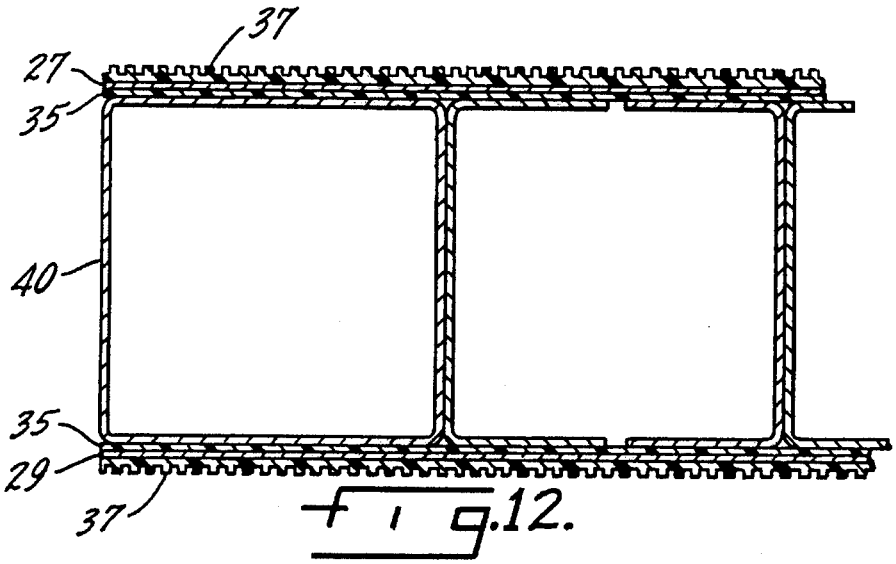
Fig. 12.

TELESCOPIC BRIDGE PLATE ASSEMBLY

THE FIELD OF THE INVENTION

The present practice in loading automotive type motor vehicles including light trucks, vans, and sport utility vehicles onto railroad multi-level auto rack freight cars (freight cars) for shipment by rail is to drive the motor vehicle onto one end of a string of freight cars coupled together. The motor vehicles are driven into the first freight car on either the first, second, or third deck, depending upon the type and size of multi-level auto rack freight car, with the gap between the adjoining decks of adjacent freight cars being spanned by a pair of portable bridge plates. Each pair of bridge plates supports the motor vehicle as it is driven over the gap between the decks of adjacent freight cars with one plate supporting the right side and the other the left side of the motor vehicle. Conventionally, the portable bridge plates are mounted to the freight cars only during loading and unloading of the motor vehicles. The Association of American Railroads (AAR) specifies a maximum weight of 40 pounds and a minimum strength requirement of 4500 pounds and a fatigue load of 1500 pounds for portable bridge plates in AAR Specification M-951. Conventionally, portable bridge plates are made of aluminum plate with a steel hinge and weigh between 37 and 40 pounds, but nevertheless, they are still difficult for both male and female employees (workmen) to handle during installation and/or removal and often are the cause of personal injury, as well as damage to the plate itself. Conventionally, the portable bridge plates are pivotally attached to one end of one freight car and span the gap to the deck of the adjacent freight car. The portable bridge plates are only attached to a freight car at one end so as to accommodate variable spacing between adjacent coupled freight cars in the string that have been spotted for loading and/or unloading. Pivotal attachment is by a spring-biased latch which has limited accessibility as the latch can only be accessed from the bottom of the bridge plate, again making the job of the workmen more difficult during installation and removal at certain deck positions.

A further problem with the present type of portable bridge plate is that its size is not sufficient to accommodate recent and future changes to motor vehicle and freight car designs. The problem with the present type of portable bridge plate is that its width is not sufficient to accommodate motor vehicles with narrow tracks now being used on some subcompact and future motor vehicle designs. These motor vehicles' lateral wheel spacing is too narrow and cannot properly span the distance between the pair of portable bridge plates. Without extreme care, these motor vehicles may fall between the bridge plates spanning the gap between adjacent freight cars. Some motor vehicle manufacturers have advised that this track dimension will be reduced even further in the future.

A further problem with the present portable bridge plate is that it cannot accommodate a recent increase in the gap between adjacent freight cars. AAR Specification M-921D relative to freight car draft gear requires all freight cars to be modified over the next four years. The new specification requires a 50,000 pound pre-load to be built into each freight car draft gear to reduce in-train longitudinal forces. The old specification had no pre-load and the freight cars could be easily bunched together to accommodate the present bridge plate design. Now with the required pre-load, the freight cars cannot be bunched as close together and the present portable bridge plate is too short to properly span the gap between adjacent freight car decks. No longer will it be possible to set the hand brake at one end of a string of freight cars being positioned for loading or unloading of motor vehicles and then compress the freight cars together by applying force from an engine at the opposite end. The pre-load required by AAR Specification M-921D will not allow the draft gears to compress (the end freight car wheels will slide on the rail with the hand brake set) allowing the space between freight cars to be reduced using this compressing method with the result that the current portable bridge plate will not be able to properly span the gap between the decks of adjacent freight cars. To make the portable bridge plates of the current design wider and longer and meet the AAR minimum loading requirements would cause the plates to weigh more than the AAR mandated 40 pounds maximum.

A further problem with the present type of portable bridge plate is that the non-pivotally attached end of the plate rests on the adjacent freight car deck. However, because of the variable gap between adjacent freight cars and the several designs of different manufacturers of auto racks, the bridge plate often rests upon obstructions such as door locks, chain rails and chock rails. When the plate rests upon these obstructions the vertical height for the motor vehicle is reduced leading to roof damage of the vehicle and the end of the bridge plate presents a sharp metal edge that can damage the motor vehicle rubber tires.

A further problem with the present type of portable bridge plate is that its top surface is painted with an antiskid paint to provide traction and a bright safety color as the motor vehicle is driven across. This paint wears off with usage and is a high maintenance item. Also, the shape of the present plate allows it to collect water, snow and ice which reduces traction and often falls on the workmen during removal.

An additional problem with the present portable bridge plate is that the top and bottom are not reversible, requiring the workman to pick it up in the proper orientation to install it on the freight car or set it down and reorient the handhold. This is not always easy to accomplish since the workman may be as high as fourteen feet above the rails. A further problem with the present portable bridge plate is that it does not have a handhold at the non-locking end.

The present invention provides a lightweight, easily handled, reversible portable bridge plate assembly which has sufficient width to handle narrow track motor vehicles and is variable in length to span any reasonable gap between decks of adjacent freight cars and will not rest on floor obstructions that would cause motor vehicle damage. The maximum weight of the bridge plate assembly is approximately 30 lbs. The portable bridge plate assembly is formed of a pair of telescoping panel members, one of which is comprised of thin, high strength facing layers bonded to a much thicker intermediate low density and lightweight core material. The bond is formed by a tough but rigid adhesive attaching the facings to the core. The other panel member, shorter in length, in part encloses the composite panel member and is in the nature of a hollow shroud. Each panel member is pivotally attached to one end of a freight car with a spring-biased latch which is accessible from either the top or bottom through a hand opening used by the workmen to move and orient the portable bridge plate assembly during installation and removal. There is a flexible cable which limits the maximum extension of the panel members and there are biasing springs which urge the telescopic panel members toward maximum extension.

SUMMARY OF THE INVENTION

The present invention relates to portable bridge plates for use in loading and unloading automotive type motor vehicles onto and off of rail cars, and particularly relates to a lightweight, easily installed and removed portable bridge plate assembly in which one of the panel members has a sandwich construction comprised of thin, high strength facing layers top and bottom bonded with a tough but rigid adhesive to an intermediate, much thicker, low density and lightweight core material.

Another purpose of the invention is a portable bridge plate assembly which weighs substantially less than the AAR maximum weight limitation of 40 lbs., meets the AAR minimum strength requirements, has sufficient width to be useful with all automotive type motor vehicle designs, including narrow tracked motor vehicles, and has adequate length to span the gap between the decks of adjacent freight cars.

Another purpose of the invention is a portable bridge plate assembly which has adjustable length to span the variable gap between decks of adjacent freight cars by using a pair of telescoping panel members, each of which is pivotally attached to an end of an adjoining freight car.

Another purpose of the invention is a portable bridge plate assembly that has a hand-hold at each end to improve the ease of handling by workmen.

Another purpose of the invention is a portable bridge plate assembly wherein the spring-biased locking mechanism of the pivotal attachment is accessible from both the top and bottom of the bridge plate assembly.

Another purpose of the invention is a portable bridge plate assembly that is reversible for ease of use by the workmen.

Another purpose of the invention is a portable bridge plate assembly that clears all floor obstructions of various freight car deck designs, thus providing maximum motor vehicle vertical clearance.

Another purpose of the invention is a portable bridge plate assembly as described in which there is a stop limiting the maximum extension of the telescoping plate members and there are springs urging the telescoping plate members toward maximum extension.

BRIEF DESCRIPTION OF THE DRAWINGS

The invention is illustrated diagrammatically in the following drawings wherein:

FIG. 4 is a top view of one of the panel members;

FIG. 5 is an end view of the panel member of FIG. 4;

FIG. 6 is a section along plane 6—6 of FIG. 4;

FIG. 7 is an enlarged vertical section of the panel member of FIG. 4;

FIG. 8 is an enlarged top view of the core of the FIG. 4 panel;

FIG. 9 is a top view of the other panel member;

FIG. 10 is an end view of the panel members of FIG. 9;

FIG. 11 is an enlarged partial section of the panel member of FIG. 9; and FIG. 12 is a section along plane 12—12 of FIG. 9.

DESCRIPTION OF THE PREFERRED EMBODIMENT

Figure 1:
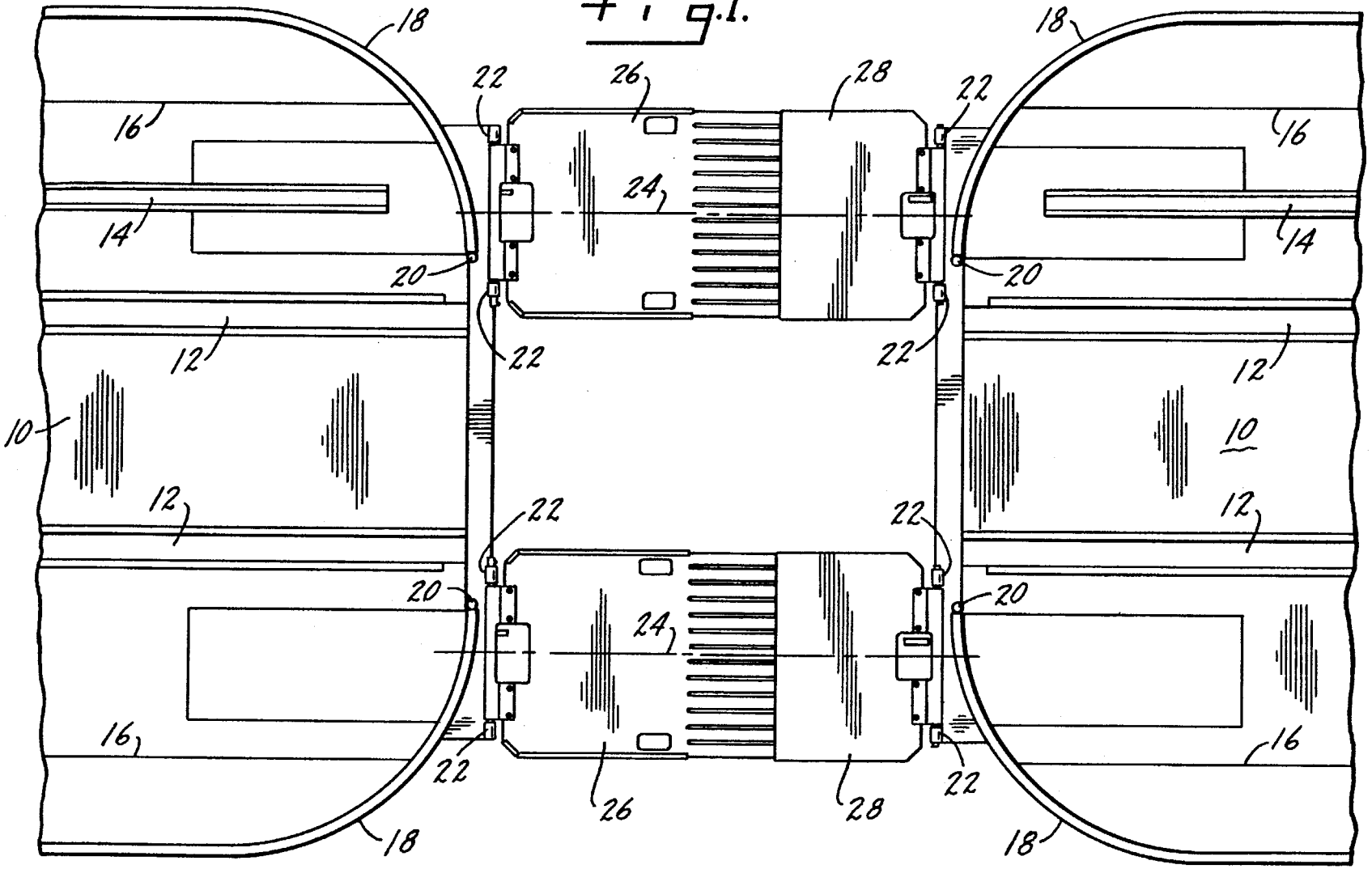
FIG. 1 is a top plan view of the adjoining ends of rail cars showing the bridge plate assembly of the present invention in position.
Figure 2:
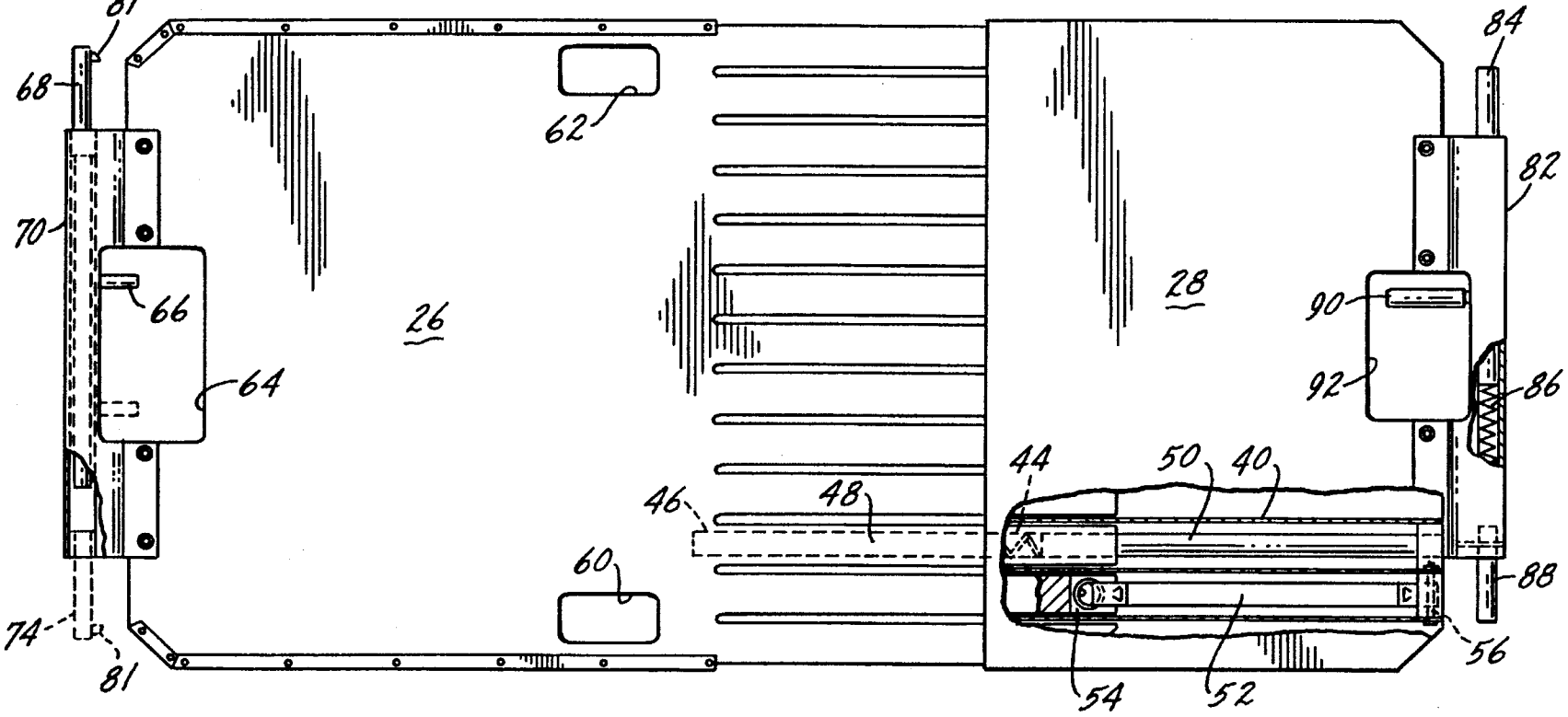
FIG. 2 is an enlarged top view of the bridge plate assembly, in part section.
Figure 3:
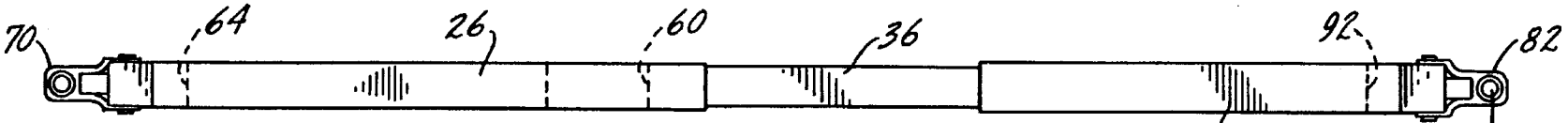
FIG. 3 is a side view of the bridge plate assembly.

In the drawings, one end of a typical rail car for use in transporting automotive type vehicles has a floor 10 with spaced chain rails 12. Outboard of one of the chain rails 12 is a wheel chock track 14. One set of the vehicle wheels will pass between the chock track 14 and the chain rail 12, with the vehicle being chained to the chain rail and chocks being used to restrain the vehicle wheels. The interior walls of the rail car are indicated at 16, and as is conventional, there are arcuate doors at each end, with the track for the doors being shown at 18 and the door stops being indicated at 20. At each end of the car, there are barrel rings 22, there being a pair of such rings for each bridge plate assembly, with the centerline 24 of each bridge plate assembly being intermediate the barrel rings. Each bridge plate assembly must be sufficient in width to accommodate both wide track and narrow track vehicles and in fact automotive type vehicles of almost any wheelbase which can fit within the confines of the multideck rail car.

Each bridge plate assembly includes a pair of telescoping panel members, one of which is indicated at 26, and the other at 28. The panel members are telescopic, relatively movable and stopped to limit maximum extension. The panel member 26 consists of top and bottom facing layers 30 and 32, respectively, with a honeycomb core sandwiched between. The core is indicated at 34. Preferably, the face layers are formed of 2024T3 aluminum sheet having a thickness of 0.32" and the honeycomb core 34 is formed of aluminum core material bearing the designation 3003 and with a space between cell walls of 0.25". FIG. 8 illustrates the configuration of the honeycomb core. An epoxy film adhesive 31, such as L-302XL, is used to bond the face layers 30 and 32 to the core material 34. The facing layers 30 and 32, which are interchangeable in that either side of the bridge plate assembly may be the top or the bottom, will have an anti-skid coating 33 designated as L-302 Trico yellow baked thereon. The anti-skid coating provides increased traction for vehicles while protecting the aluminum sheet against wear, abrasion and the elements.

The center end of the panel member 26 has a plurality of fingers 36 which are formed by slits 38 separating each of the fingers.

The panel member 28 is in the nature of a shroud or cover in that it extends in part over the fingers 36 of plate member 26. The shroud 28 may also have face layers 27 and 29 formed of aluminum sheet of the same type and thickness as described for the face layers of member 26. Positioned within the shroud 28 are a plurality of parallel tubes indicated at 40, with the tubes providing a hollow space for reception of the fingers 36 when the panel members are telescoped together. There are end caps 42 at the end of certain of the tubes. The tubes 40 may also be formed of 2024T3 aluminum sheet, 0.032" thick, and will be bonded by the same type of epoxy film 35 to the face layers 27 and 29. The same anti-skid coating 37 will be baked onto the exterior of the face layers for panel member 28.

The telescoping panel members are biased away from each other by a pair of coil springs, one of which is indicated at 44. Each of the springs 44 is positioned within a stainless steel sleeve 46 which is itself mounted within one of the fingers 36 indicated particularly at 48. The springs are seated upon the end of each of the sleeves and extend outwardly from the stainless steel sleeves and into contact with a coaxially aligned sleeve 50 which may, for example, be formed of PVC and is positioned within one of the hollow tubes 40 of the shroud 28. Thus, the springs bias the panel members 26 and 28 in opposite directions toward a position of maximum extension. Such position is determined by the length of a pair of flexible straps, one of which is indicated at 52. The straps are preferably of braided plastic fibers, thin and flexible, and are attached at one end to a fitting 54 which is fixed within one of the plate member 26 fingers 36. The opposite end of each cable 52 is attached to a clevis pin 56 attached to the sides of one of the tubes 40. Thus, the straps 52 determine the maximum extension of the telescoping panel members and when the panel members are at less than maximum extension the thin, flexible straps will bend and flex within the confines of the tubes 40 of the shroud 28.

Panel member 26 has a pair of hand-holds 60 and 62 at opposite sides thereof for use by workmen in manipulating the plate assembly. At the outboard end of plate member 26 there is a further hand opening 64 providing access to a handle 66 which is attached to a floating pin 68. The pin 68 is movable within a sleeve 70 and the handle 66 is used to move the pin 68 back and forth within the sleeve. However, in order to lock the pin 68 so that it extends from one end or the other of sleeve 70, as shown in dotted lines at 74, the sleeve includes a locking slot 76 which has an elongated portion 78 and a pair of locking portions 80 at each end thereof. The handle 66 will be used to move the pin 68 and the locking portions 80 are used to lock the pin so that it extends from one end or the other of sleeve 70. Each end of pin 68 has a bullet catch 81 which is used to hold pin 68 in one or the other of the barrel rings 22.

At the outboard end of shroud 28 there is similarly a latch to attach the plate assembly to the end of a rail car. There is a sleeve 82 within which is mounted a reciprocal pin 84 with the pin being urged in an outward direction by a coil spring 86. There is also a fixed pin 88 extending outwardly from the opposite end of the sleeve. Movement of pin 84 is controlled by a handle 90 which is accessible through a hand opening 92 similar to that on panel member 26.

In installing the plate assembly, the so-called hinged end, which is the outboard end of the shroud 28, is first attached to a rail car by inserting the fixed pin 88 into one of the barrel rings 22. To do this, the locking pin must be retracted by handle 90 and once it is in alignment with the barrel ring it may be released. The springs 44 will retain the plate assembly at its maximum extension. If the distance between adjoining rail cars is less than the maximum extension, the workmen will push the panel members together to an appropriate distance, after which the floating pin 68 is aligned with one of the barrel rings on the other car. The pin 68 is retracted and then moved so that it will fit within the barrel ring. The handle 66 will be locked in one of slot portions 80 and the bullet catch will be used to further hold the pin within the selected barrel ring. When the plate assembly is completely attached to adjoining ends of rail cars, there will be pins inserted in three of the four barrel rings at the opposed ends of the cars.

Of particular advantage in the invention is the lightweight construction of the panel members, the ease of handling for installation of the plate assembly to the adjoining ends of rail cars, and the fact that the telescoping panel members are biased to maximum extension, but limited in extension by the straps which function as limiting stops. The invention is simple in construction, lightweight, and easy to install.

Whereas the preferred form of the invention has been shown and described herein, it should be realized that there may be many modifications, substitutions and alterations thereto.

The embodiments of the invention in which an exclusive property or privilege is claimed are defined as follows:

1. A portable bridge plate assembly attachable to and removable from facing ends of rail cars for use in moving vehicles between stationary rail cars for loading and unloading, said plate assembly having a maximum weight of 40 lbs., a minimum strength requirement of 4500 lbs., and a fatigue load of 1500 lbs., said plate assembly having sufficient length to span the space between adjacent rail cars, having sufficient width to accommodate vehicles of varying wheelbase and having sufficient strength to support a vehicle, said plate assembly including two relatively movable telescoping load bearing panel members, said panel members being secured together for relative movement to accommodate variant spacing between the facing ends of stationary rail cars, means biasing said relatively movable panel members toward maximum extension and means limiting the maximum extension of said panel members.

2. The bridge plate assembly of claim 1 wherein said biasing means includes at least one spring positioned at least in part within one of said panel members and biasing the other panel member outwardly therefrom.

3. The bridge plate assembly of claim 2 including a pair of springs, each located within a tubular compartment in said one panel member.

4. The bridge plate assembly of claim 3 wherein said other panel member has a pair of stop members positioned for contact, one with each said spring.

5. The bridge plate assembly of claim 1 wherein the means limiting maximum extension of said panel members includes a flexible strap connected at opposite ends to said panel members.

6. The bridge plate assembly of claim 1 wherein one of said panel members includes top and bottom face layers bonded to an intermediate low density core.

7. The bridge plate assembly of claim 6 wherein said core has a honeycomb configuration.

8. The bridge plate assembly of claim 6 wherein the other of said panel members is generally hollow and in part encloses said one panel member.

9. The bridge plate assembly of claim 7 wherein said core is formed of aluminum.

10. The bridge plate assembly of claim 6 wherein said face layers are aluminum bonded with an epoxy to said core.

11. The bridge plate assembly of claim 1 wherein each said panel member includes means for attaching the outward end thereof to a rail car.

12. The bridge plate assembly of claim 11 wherein the means for securing at least one of said panel members to the end of a rail car includes a spring-biased latch.

13. The bridge plate assembly of claim 8 wherein said one panel member has a plurality of parallel fingers extending toward said other panel member, said other panel member having a plurality of parallel tubes for receiving said fingers.

* * * * *